US007481400B2

(12) United States Patent
Appleby et al.

(10) Patent No.: US 7,481,400 B2
(45) Date of Patent: Jan. 27, 2009

(54) RAILWAY WHEEL SENSOR

(75) Inventors: Glen Appleby, St-Lazare (CA); Stephen W. Brown, Montreal (CA); Kostas Papazoglou, Dollard-des-Ormeaux (CA)

(73) Assignee: Portec, Rail Products Ltd., Lachine, Quebec (CA)

( * ) Notice: Subject to any disclaimer, the term of this patent is extended or adjusted under 35 U.S.C. 154(b) by 424 days.

(21) Appl. No.: 11/172,630

(22) Filed: Jul. 1, 2005

(65) Prior Publication Data

US 2007/0001059 A1 Jan. 4, 2007

(51) Int. Cl.
*B61L 11/00* (2006.01)

(52) U.S. Cl. ..... 246/249; 246/122 R; 246/247; 324/174; 340/941

(58) Field of Classification Search ..... 246/122 R, 246/249, 124, 247; 324/173, 174, 179, 207.2, 324/251; 340/941
See application file for complete search history.

(56) References Cited

U.S. PATENT DOCUMENTS 3,015,725 A * 1/1962 Hofstetter et al. ..... 246/247
3,297,866 A 1/1967 Lippmann et al.
3,504,173 A 3/1970 Brinker
3,964,703 A 6/1976 Wilkas et al.
4,200,855 A * 4/1980 Gilcher ..... 338/5
4,518,918 A * 5/1985 Avery ..... 324/207.2
4,524,932 A 6/1985 Bodziak
4,727,372 A 2/1988 Buttemer
4,739,264 A 4/1988 Kamiya et al.
5,084,674 A 1/1992 Lachmann et al.
5,129,606 A 7/1992 Rodems et al.
5,265,831 A * 11/1993 Muller ..... 246/124
5,395,078 A 3/1995 Gellender
5,578,977 A 11/1996 Jansseune
5,628,479 A 5/1997 Ballinger
5,640,090 A 6/1997 Furuya et al.
5,844,427 A 12/1998 Theus et al.
6,020,815 A 2/2000 Eslambolchi et al.
6,064,315 A 5/2000 Orlassino et al.
6,371,417 B1 4/2002 Southon (Continued)

FOREIGN PATENT DOCUMENTS

WO WO 97/49593 12/1997

OTHER PUBLICATIONS

International Search Report,PCT/CA2006/001073,Oct. 31, 2006.

*Primary Examiner*—Mark T Le
(74) *Attorney, Agent, or Firm*—Robert P. Lenart, Esq.; Pietragallo Gordon Alfano Bosick & Raspanti, LLP

(57) ABSTRACT

A sensor for detecting the presence of wheels of a rail vehicle includes first and second Hall Effect devices, a magnet for supplying a magnetic field to the first and second Hall Effect devices, the first and second Hall Effect devices and the magnet being mounted adjacent to the rail, whereby a railway vehicle wheel changes the magnetic field in the Hall Effect devices to produce wheel indication signals, and a processing circuit for receiving the wheel indication signals from the first and second Hall Effect devices and for producing an output signal in response to the wheel indication signals. A method of detecting the presence of a wheel is also provided.

14 Claims, 6 Drawing Sheets

U.S. PATENT DOCUMENTS 6,663,053 B1 12/2003 Shams
6,703,830 B2 3/2004 Kaste
6,727,684 B2 4/2004 Hatanaka
6,848,658 B2 * 2/2005 McAllister ..... 246/122 R
7,250,748 B2 * 7/2007 Hastings et al. ..... 324/117 R

* cited by examiner

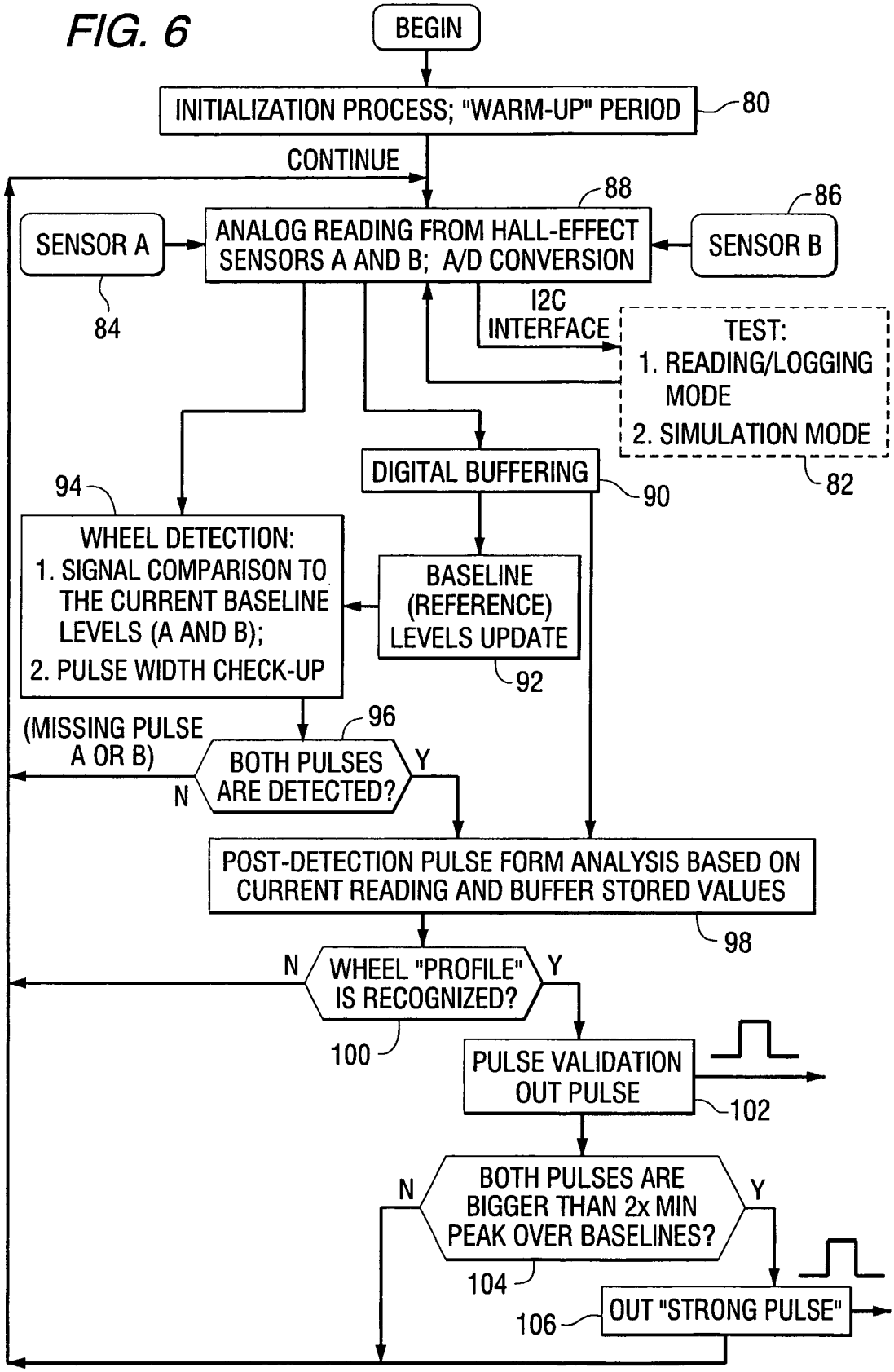
FIG. 6
BEGIN
INITIALIZATION PROCESS; "WARM-UP" PERIOD
80
CONTINUE
88
86
SENSOR A
ANALOG READING FROM HALL-EFFECT SENSORS A AND B; A/D CONVERSION
SENSOR B
84
I2C INTERFACE
TEST:
1. READING/LOGGING MODE
2. SIMULATION MODE
82
DIGITAL BUFFERING
90
94
WHEEL DETECTION:
1. SIGNAL COMPARISON TO THE CURRENT BASELINE LEVELS (A AND B);
2. PULSE WIDTH CHECK-UP
BASELINE (REFERENCE) LEVELS UPDATE
92
(MISSING PULSE A OR B)
96
BOTH PULSES ARE DETECTED?
N
Y
POST-DETECTION PULSE FORM ANALYSIS BASED ON CURRENT READING AND BUFFER STORED VALUES
98
N
WHEEL "PROFILE" IS RECOGNIZED?
Y
100
PULSE VALIDATION OUT PULSE
102
N
BOTH PULSES ARE BIGGER THAN 2x MIN PEAK OVER BASELINES?
Y
104
106
OUT "STRONG PULSE"

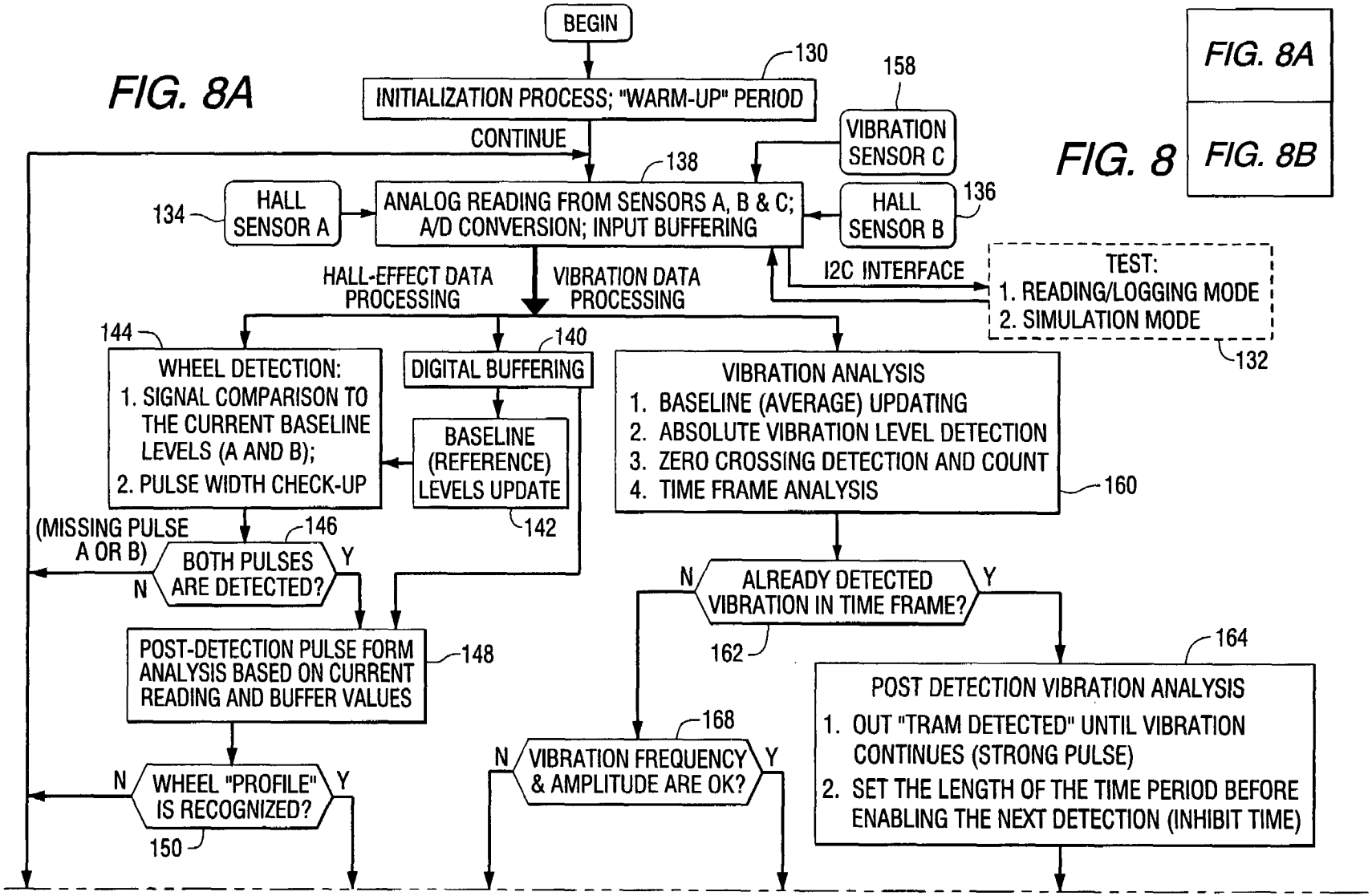
FIG. 8A
FIG. 8B
FIG. 8
BEGIN
INITIALIZATION PROCESS; "WARM-UP" PERIOD
130
CONTINUE
138
ANALOG READING FROM SENSORS A, B & C; A/D CONVERSION; INPUT BUFFERING
VIBRATION SENSOR C
158
HALL SENSOR B
136
HALL SENSOR A
134
I2C INTERFACE
TEST:
1. READING/LOGGING MODE
2. SIMULATION MODE
132
HALL-EFFECT DATA PROCESSING
VIBRATION DATA PROCESSING
DIGITAL BUFFERING
140
BASELINE (REFERENCE) LEVELS UPDATE
142
WHEEL DETECTION:
1. SIGNAL COMPARISON TO THE CURRENT BASELINE LEVELS (A AND B);
2. PULSE WIDTH CHECK-UP
144
146
BOTH PULSES ARE DETECTED?
Y
N
(MISSING PULSE A OR B)
VIBRATION ANALYSIS
1. BASELINE (AVERAGE) UPDATING
2. ABSOLUTE VIBRATION LEVEL DETECTION
3. ZERO CROSSING DETECTION AND COUNT
4. TIME FRAME ANALYSIS
160
ALREADY DETECTED VIBRATION IN TIME FRAME?
162
POST DETECTION VIBRATION ANALYSIS
1. OUT "TRAM DETECTED" UNTIL VIBRATION CONTINUES (STRONG PULSE)
2. SET THE LENGTH OF THE TIME PERIOD BEFORE ENABLING THE NEXT DETECTION (INHIBIT TIME)
164
VIBRATION FREQUENCY & AMPLITUDE ARE OK?
168
POST-DETECTION PULSE FORM ANALYSIS BASED ON CURRENT READING AND BUFFER VALUES
148
WHEEL "PROFILE" IS RECOGNIZED?
150

RAILWAY WHEEL SENSOR

FIELD OF THE INVENTION

This invention relates to methods and apparatus for monitoring railway vehicles, and in particular to a method and apparatus used to detect the presence of railway wheels on a track.

BACKGROUND OF THE INVENTION

A variety of devices for sensing the presence of train wheels have been previously proposed. These sensing devices include photoelectric devices, mechanical switches, load sensing, proximity switch technologies and magnetic disturbance measuring devices.

Electromagnetic interference is very common in the electrified railway environment, for example AMTRAK, streetcars, and Metro systems. The interference is due primarily to the electromagnetic field that is induced between the power conductor and the return conductor as the locomotive (or Electric Multiple Unit, EMU) draws power. The fields can also radiate from the conductors depending on the grounding.

There is a need for a railway wheel sensor that can operate even when subjected to electromagnetic interference.

SUMMARY OF THE INVENTION

This invention provides a sensor for detecting the presence of wheels of a rail vehicle. The sensor comprises first and second Hall Effect devices, a magnet for supplying a magnetic field to the first and second Hall Effect devices, means for mounting the first and second Hall Effect devices and the magnet adjacent to a rail, whereby a railway vehicle wheel changes the magnetic field in the Hall Effect devices to produce wheel indication signals, and a processing circuit for receiving the wheel indication signals from the first and second Hall Effect devices and for producing an output signal in response to the wheel indication signals.

A vibration sensor can be included to provide a vibration indication signal. The vibration indication signal can be combined with the output signal to produce an additional output signal.

In another aspect, the invention provides a method of sensing the presence of a railway vehicle, the method comprising the steps of: positioning first and second Hall Effect devices adjacent to an elongated rail, applying a magnetic field to first and second Hall Effect devices, producing first and second wheel indication signals in response to a change in the magnetic field in the first and second Hall Effect devices caused by an adjacent railway vehicle wheel, and producing an output signal in response to the first and second wheel indication signals.

The method can further comprise the steps of: sensing vibrations caused by the railway vehicle and producing a vibration indicating signal, and combining the vibration indicating signal and the wheel indication signals to produce the output signal.

The invention further provides a sensor for sensing the presence of a railway vehicle wheel on an elongated rail comprising a vibration sensor, means for mounting the vibration sensor adjacent to the rail, whereby the vibration sensor produces a vibration indication signal in response to vibration in the rail, and a processor for receiving the vibration indication signal, for validating the vibration indication signal, and for producing an output signal in response to the vibration indication signal if the vibration indication signal is valid.

The invention also provides a method for sensing the presence of a railway vehicle wheel on an elongated rail, comprising the steps of: mounting a vibration sensor adjacent to the rail, whereby the vibration sensor produces a vibration indication signal in response to vibration in the rail, validating the vibration indication signal, and producing an output signal in response to the vibration indication signal if the vibration indication signal is valid.

BRIEF DESCRIPTION OF THE DRAWINGS

FIGS. 6, 7 and 8 are flow charts that illustrate the signal processing performed in the method of the invention.

DETAILED DESCRIPTION OF THE INVENTION

Figure 1:
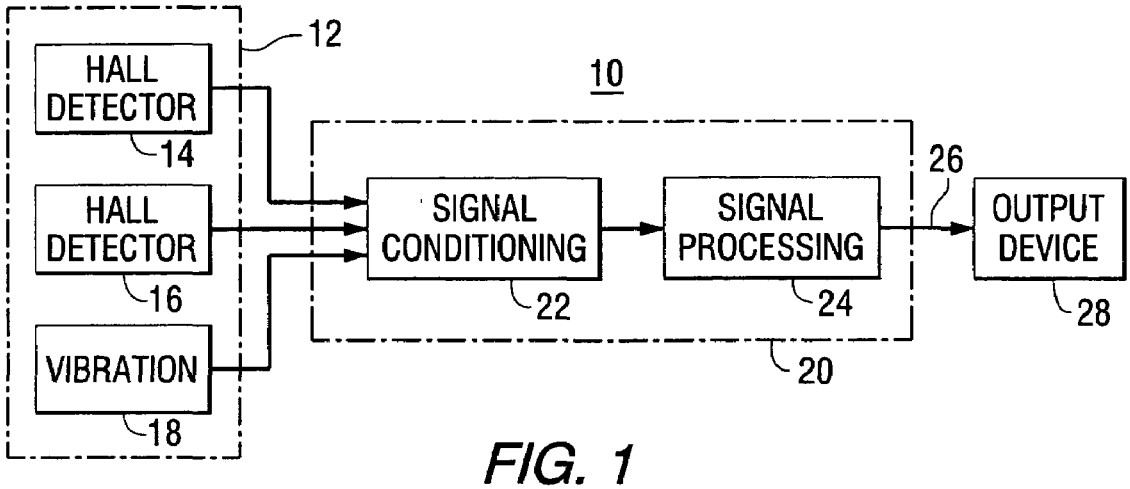
FIG. 1 is a block diagram of a system that includes the wheel detecting sensor of this invention.

Referring to the drawings, FIG. 1 is a block diagram of a system 10 that includes the wheel sensor of this invention. The system includes a sensor assembly 12 that includes first and second Hall Effect detectors 14 and 16, and a vibration sensor 18. Output signals from the Hall Effect detectors 14 and 16, and the vibration sensor 18 are received by a signal processing circuit 20 and processed to provide an output signal. The signal processing circuit includes a signal conditioning circuit 22 and a processor 24, which can be for example, a microprocessor or a microcontroller. The signal processing circuit produces one or more output signals on line 26, which can be representative of the wheel count, train speed, or other parameter measured by the vibration sensor and/or the Hall Effect detectors. An output device 28 can be included to provide a function that is responsive to the output signal from the processor. For example, the output device can provide a display of a wheel count or vehicle speed in response to the processor output signal. The output device may also, or alternatively, transmit the output signal to a remote location or to other equipment, such as friction modifying equipment that can apply friction modifying material to the rail in response to the processor output signal.

In one embodiment, the Hall Effect detectors and the vibration sensor can be directly connected to the analog inputs of a microcontroller or microprocessor. The microcontroller can have communications capabilities and an interface for high speed data transmission to a data collecting terminal, such as a portable computer.

The wheel sensor can be used to continuously monitor and log the passage of trains by linking it to laptop computer or other computer system. This operating mode and a standalone mode allow for continuous fine tuning of the signal processing algorithm, if necessary, due to changing track environments or conditions that were not previously encountered. The system can also utilize flash reprogrammable microprocessors that can be updated in the field.

Figure 2:
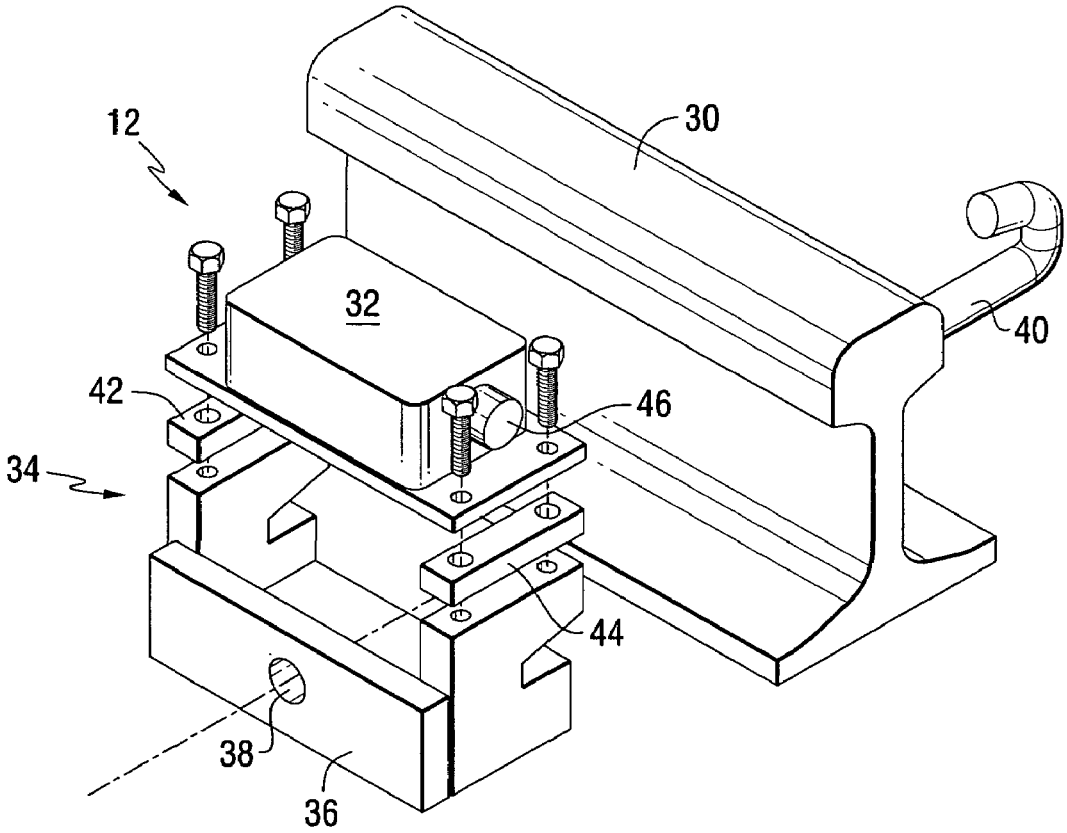
FIG. 2 is a pictorial representation of a wheel sensor assembly installed on a rail.

The system 10 uses two independent technologies (Hall Effect devices and a vibration sensor) to validate the presence of a train and to count the wheels. FIG. 2 is a pictorial representation of a sensor assembly 12 and an adjacent rail 30. The sensor assembly 12 is contained within a housing 32 that is supported by a mounting block 34 that is attached to the rail. In this example, the mounting block includes a cross piece 36 having an opening 38 for receiving a conduit 40 that can supply friction modifying material to the rail using an applicator, not shown. Spacers 42 and 44 are provided for adjusting the height of the sensor assembly. A connector 46 is provided for the attachment of a cable that can be used to connect the sensor assembly to an external processor or other device. The vibration sensor is mechanically coupled to the rail through the mounting block so that the vibration sensor can sense vibration in the rail.

The wheel sensor is used primarily to detect the wheel flange of a railway wheel and would typically be mounted on the gauge side of a rail. However, it can also be mounted on the field side and used to detect the wheel tread. The wheel sensor can also be mounted closer to the base of the rail and can be used in a vibration mode in applications such as U-rail.

Figure 4:
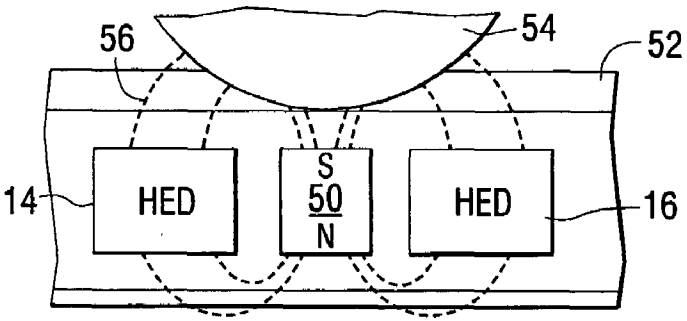
FIGS. 3 and 4 are schematic representations of the Hall Effect elements and magnet of the invention.
Figure 3:
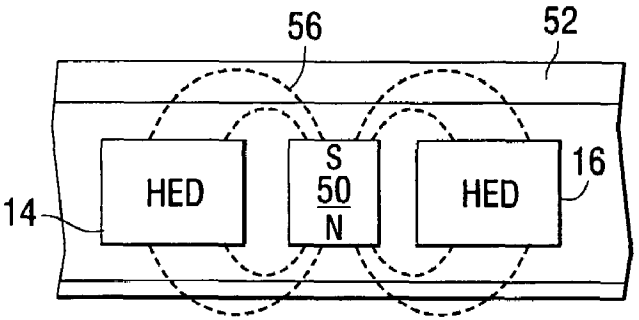

FIGS. 3 and 4 are schematic diagrams of components of the wheel detecting sensor of this invention. The two Hall Effect devices 14 and 16 are mounted on opposite sides of a magnet 50 and adjacent to a rail 52. The magnet produces a magnetic field in the Hall Effect devices. In the absence of a wheel 54, the magnet produces a flux distribution illustrated by lines 56 in FIG. 3. When a wheel is present, the wheel changes the flux distribution as illustrated in FIG. 4, such that the flux seen by the Hall Effect elements changes. This change in flux in the Hall Effect elements results in a change in the output signal of the Hall Effect elements. The Hall Effect elements are also subject to electromagnetic interference, which can affect the output signals from the Hall Effect elements.

The Hall Effect devices are installed on either side of the magnet and separated in a direction that is parallel to the direction of the train movement. The two devices are positioned in such a manner that when a train wheel passes, there is a time difference between the signals from the two Hall Effect devices. The Hall Effect devices are physically close enough to each other that when electromagnetic interference (EMI) is present, the effect of the electromagnetic interference on the outputs of the Hall Effect devices will be substantially identical.

Figure 5:
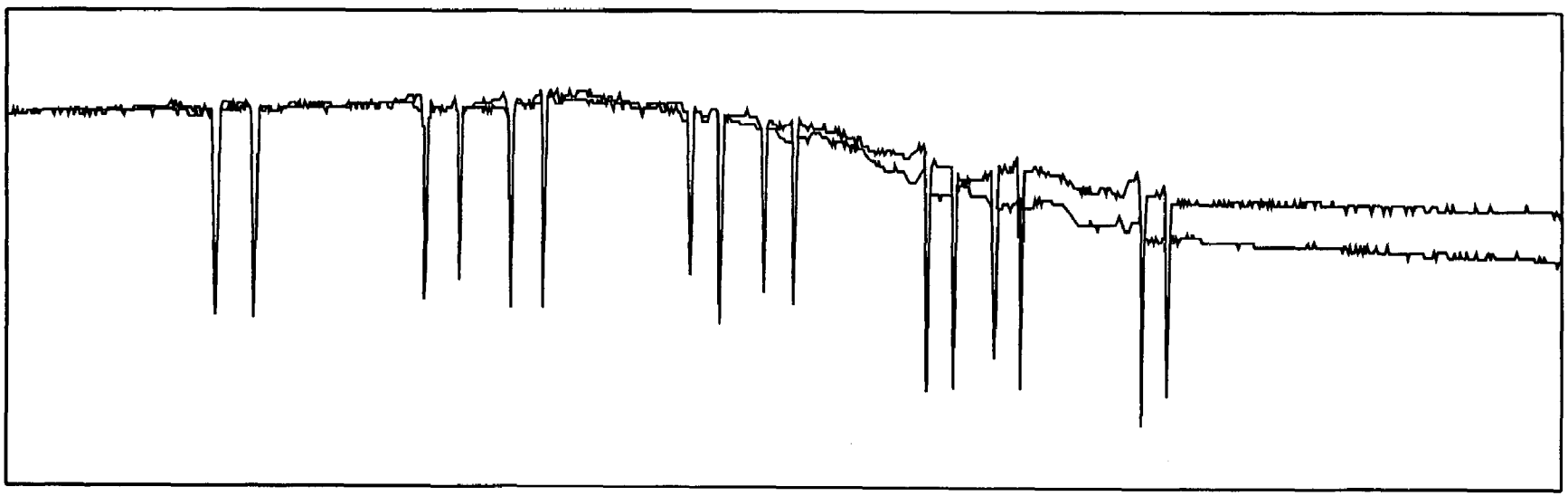
FIG. 5 shows example baseline signals used in the wheel sensor.

The output signal of the Hall Effect devices due to the presence of the wheels will almost always be different than the output signal due to the EMI. Internal signal processing also reduces false detections due to voltage induced spikes or any other random electrical or magnetic effects. During false detection, the outputs of the two Hall Effect devices do not closely follow each other. A signal processing algorithm implemented in the processing circuit monitors both of the outputs and compares the outputs to a base line as a moving average that is stored in a buffer memory. The analog signals from the two Hall Effect devices are converted to digital signals and stored to a digital buffer memory location. The contents of the buffer are tracked as a baseline since normally there are no wheels going by. The comparison is used so that when the magnetic baseline shifts due to strong electromagnetic fields, the signals will still be detected. A sample of moving baselines is illustrated in FIG. 5. The two traces in FIG. 5 are the outputs of the Hall Effects detectors. The traces in FIG. 5 represent the entire passage of a 4-vehicle electric passenger train. The rails serve as the return line for the electricity and the changing levels are due to electromagnetic effects on the Hall Effect detectors.

The smart wheel sensor of this invention can be operated in several modes. FIG. 6 is a flow chart showing signal processing when the two Hall Effect sensing elements are used. The wheel sensor detects a metal wheel by reading and processing electrical signals from the two Hall Effect devices. The wheel sensor produces a "clear" digital output pulse for each recognized wheel. In one embodiment, all functions are performed by small, 8-bit one-chip microcontroller.

Referring to FIG. 6, after the smart wheel sensor is energized, the device undergoes an initialization process as shown in block 80 wherein the microcontroller's program configures the I/O pins of the chip and initializes its variables. There is a short period of time for setting up the normal operational conditions of Hall Effect devices and other electronics (the "warm-up" period).

The microcontroller program algorithm allows communication with external devices (for example, a personal computer (PC) or controller) using an I2C standard serial protocol in two different test modes: a simulation mode and a data reading/logging mode, as shown in block 82. In the simulation mode, external data is loaded from a PC to the wheel sensor. The purpose of this mode is to test the program logic and digital processing. In the data reading/logging mode, the outputs of the Hall Effect devices are read after analog-to-digital conversion. The purpose of this mode is to check and calibrate the Hall Effect devices, as well as to log data directly to an external device like a laptop computer.

The normal operational program cycle is designed to perform a fast and secure detection of train wheels by using the quasi-parallel processing of the Hall Effect device signals, including: analog-to-digital conversion, digital data buffering, baseline level updating, pulse level and width detection, pulse form analysis, and pulse validation.

Hall Effect devices 84 and 86 produce analog signals that are read and converted to digital signals as shown in block 88. The digital signals are buffered in a memory 90 and used to update baseline reference levels as shown in block 92. The signals from the two Hall Effect devices are processed in parallel, compared to the baseline levels, and subjected to a pulse width check-up as shown in block 94.

In the pulse width check-up, the pulse width is compared to a threshold pulse width to determine if the pulse is valid. That is, for a pulse to be considered valid, it must have at least some minimum width. Alternatively, the pulse width might be compared with predetermined minimum and maximum pulse width limits. Then if the pulse width falls within those limits, the pulse is considered to be valid. If the predefined pulse level and width conditions are not met, then the algorithm rejects the signals as false indications.

If both pulses are detected as shown in block 96, processing continues in block 98 with post detection pulse form analysis based on the current reading and the buffered stored values. The current reading is the reading that the Hall Effect detectors are seeing at that moment, compared to the buffered value, which is essentially the baseline level.

If a wheel profile is recognized as shown in block 100, and the pulse is validated as shown in block 102, an output pulse is produced. The Hall Effect detectors pick up the bottom of the flange of the wheel as it passes through the magnetic flux. This flange profile can be different when compared between various freight and transit wheels, as well as in different countries.

If both pulses have a magnitude that is greater than a threshold value, such as greater than two times the baseline magnitude as shown in block 104, then a strong pulse output is produced as shown in block 106. The first output pulse provides a way of determining the tolerance for the placement of the sensor. If there is the strong pulse, then there is a larger margin for detection, whereas if there is not a strong pulse, some wheels may be missed in cases of excessive electrical interference. In that case, the sensor could be adjusted to a higher position to achieve the strong pulse.

In an alternative operating mode, the wheel sensor can be operated using only the vibration sensor component. In this operating mode, the wheel sensor detects and analyzes rail vibrations by reading and digitally processing electrical signals from a vibration sensor (for example: a polyester, laminated type). The wheel sensor produces a fixed width digital output pulse for each recognized vibration sequence (one pulse per train). In one embodiment, all functions are performed by an 8-bit, one-chip microcontroller.

Figure 7:
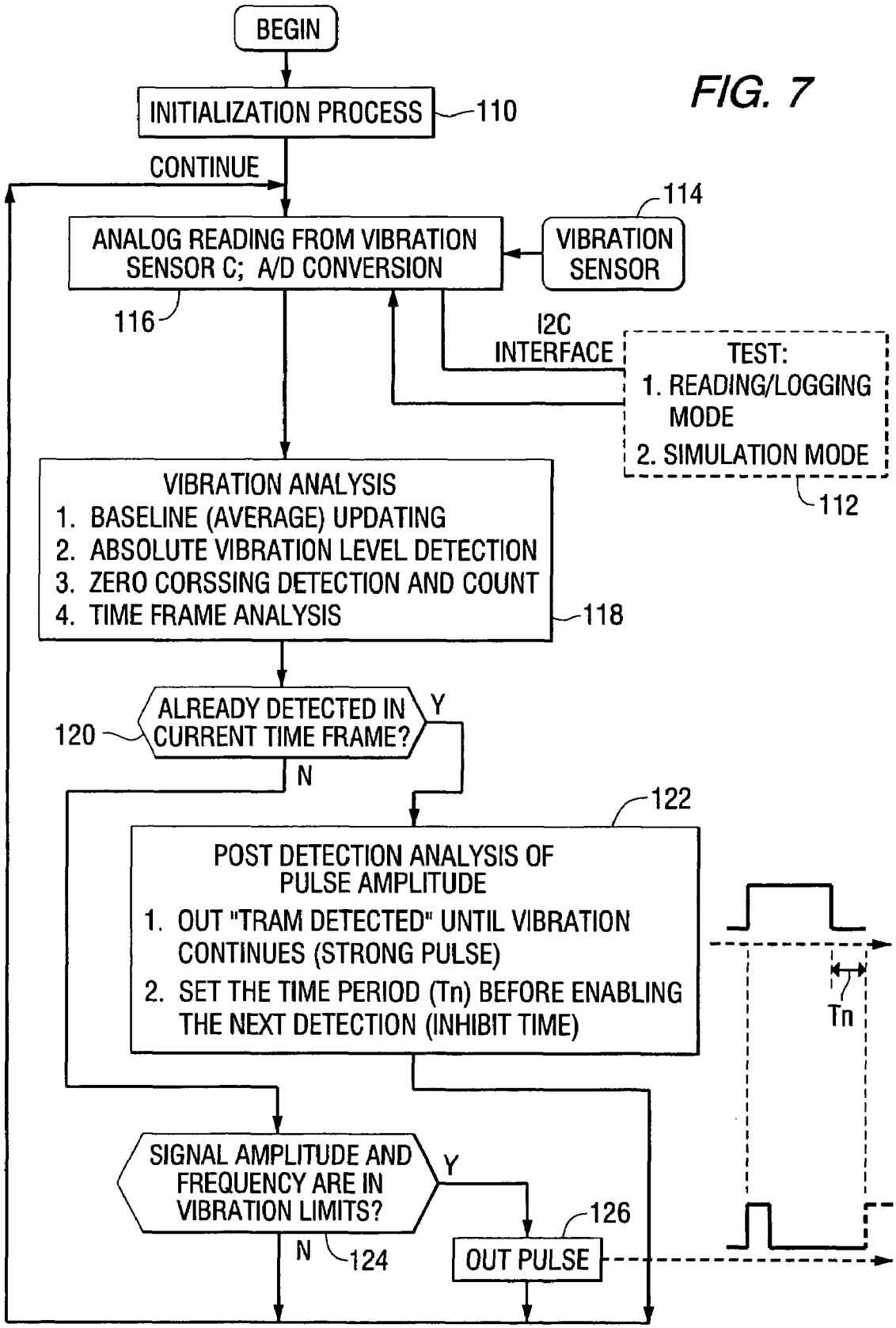

Referring to FIG. 7, after the smart wheel sensor is energized, the device undergoes an initialization process as shown in block 110 wherein the microcontroller's program configures the I/O pins of the chip and initializes its variables. There is a short period of time for setting up the normal operational conditions of the vibration sensor and other electronics ("warm-up" period).

The microcontroller program algorithm allows communication with external devices (for example, a personal computer (PC) or controller) using an I2C standard serial protocol in two different test modes: a simulation mode and a data reading/logging mode, as shown in block 112. In the simulation mode, external data is loaded from a PC to the wheel sensor. The purpose of this mode is to test the program logic and digital processing. In the data reading mode, the external device digitally reads the vibration sensor output voltage after analog-to-digital conversion. The purpose of this mode is to check the sensor component, as well as logging directly to an external device like a laptop computer.

The vibration sensor 114 produces an analog signal that is read and converted to a digital signal as shown in block 116. The digital signal is subjected to vibration analysis as shown in block 118, including baseline updating, absolute vibration level detection, zero crossing detection, and time frame analysis. In this case the baseline is an average of previous vibration signals. The absolute value of the amplitude can be used, for a preprogrammed minimum peak that can be changed. Values below the absolute value of the amplitude can serve as the baseline. In one embodiment, 256 samples are used for the average. The baseline average is constantly being updated and stored in the buffer.

If vibration has already been detected in the current time frame, as shown in block 120, then post detection analysis is performed as shown in block 122. The current time frame is the period in which the wheel sensor is calculating the average. The time frame is of a fixed length in the programming and cycles, while the tram is being detected. The tram detection is based on thresholds of amplitude and frequency.

A "tram detected" signal is produced as long as the vibration continues. Then a time period is set before enabling the next detection. The time period is set to allow for extremely slow speed trams so that they are not detected more than once, between bogies for example, or to allow for trams to stop and then proceed without multiple counts. The time period is a variable and can be set in the software. If vibration has not been detected in the current time frame, a test is performed as shown in block 124 to determine if the vibration signal amplitude and frequency are within vibration limits. If so, and output pulse is produced as shown in block 126. The limits can be set based on field testing. The limits would be programmed into the sensor's microprocessor but can be factory or field reprogrammed (as all smart sensor features can be). The purpose of this part of the flow chart is to show that we are looking to see when the tram has left the detection zone of the sensor. Once the sensor determines that the tram is gone, the timer is enabled, preventing detection for the time period discussed above.

In this operating mode, the normal operational program cycle is designed to perform a fast and secure detection of vibrations by processing the output of the vibration sensor, including: analog-to-digital conversion and buffering, baseline level updating (average level based on data integration), vibration amplitude and frequency analysis, detection of the digital pulse output, post detection analysis, and "tram detected" output pulse processing.

When operated using both the Hall Effect devices and the vibration sensor, the wheel sensor detects a metal wheel and rail vibrations by reading and digitally processing electrical signals of one vibration sensor (i.e., polyester, laminated type) and two Hall Effect solid-state components. In this mode, the wheel sensor will output digital pulses (referred to as the OUT PULSE and "STRONG" PULSE). In the preferred embodiment, all functions are performed by an 8-bit, one-chip microcontroller.

Figure 8B:
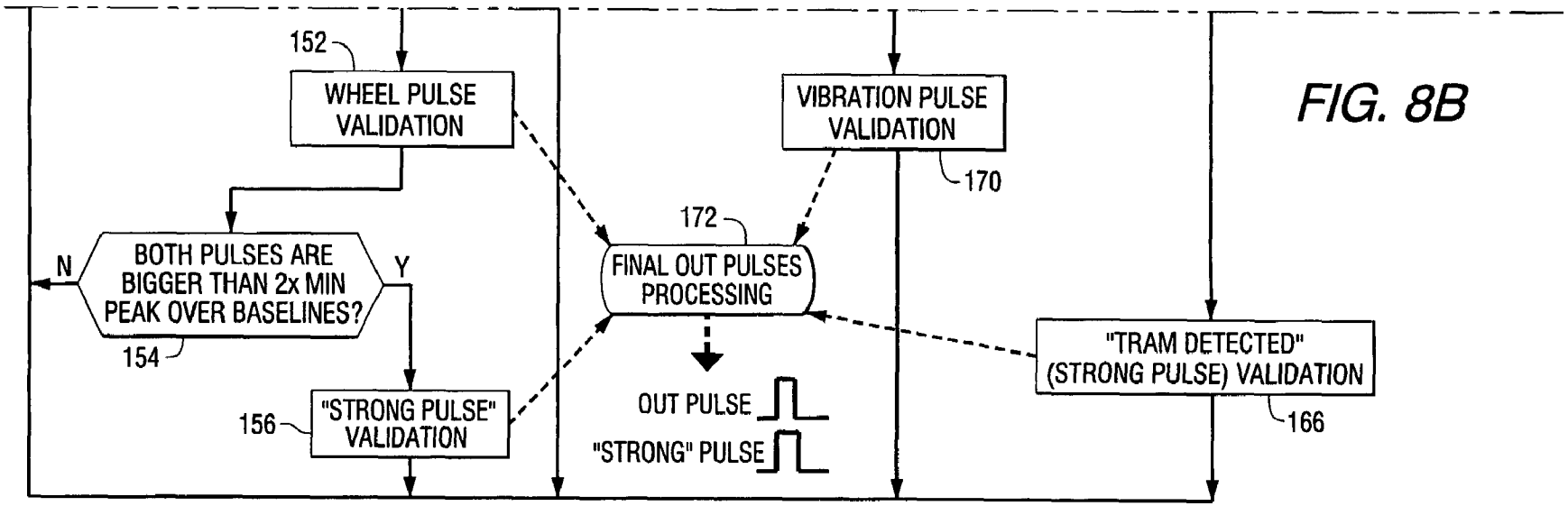

Referring to FIG. 8 (including FIGS. 8A and 8B), after the smart wheel sensor is energized, the device undergoes an initialization process as shown in block 130 wherein the microcontroller's program configures the I/O pins of the chip and initializes its variables. There is a short period of time for setting up the normal operational conditions of the sensors and other electronics ("warm-up" period).

As shown in block 132, the program algorithm allows communication with an external device (for example a personal computer (PC) or controller) using an I2C standard serial protocol and enters two different test modes: a simulation mode and a data reading/logging mode.

In the simulation mode, external data is loaded from the PC to the wheel sensor. The purpose of this mode is to test the program logic and digital processing. In the data reading/logging mode, all of the sensor output voltages are read after analog-to-digital conversion. The purpose of this mode is to check/calibrate the sensor components, as well as logging directly to an external device like a laptop computer.

The normal operational program cycle is designed to perform a fast and secure dual detection of metal wheel proximity and mechanical vibrations by using quasi-parallel processing including: analog-to-digital conversion, digital data buffering, baseline level updating, Hall Effect pulse level and pulse width detection, Hall Effect pulse form analysis, vibration amplitude and frequency analysis, vibration detection, post detection analysis, and final output pulse processing.

Hall Effect sensors 134 and 136 produce analog signals that are read and converted to digital signals as shown in block 138. The digital signals are buffered in a memory 140 and used to update baseline reference levels as shown in block 142. The signals from the two Hall Effect devices are processed in parallel, compared to the baseline levels, and subjected to a pulse width check-up as shown in block 144.

If both pulses are detected as shown in block 146, processing continues in block 148 with post detection pulse form analysis based on the current reading and the buffered stored values. If a wheel profile is recognized as shown in block 150, and the pulse is validated as shown in block 152, an output pulse is produced. If both Hall Effect device pulses have a magnitude that is greater than a threshold value, such as greater than two times the baseline magnitude as shown in block 154, then a strong pulse output is produced as shown in block 156.

The vibration sensor 158 produces an analog signal that is read and converted to a digital signal as shown in block 138. The digital signal is subjected to vibration analysis as shown in block 160, including baseline updating, absolute vibration level detection, zero crossing detection, and time frame analysis. If vibration has already been detected in the current time frame, as shown in block 162, then post detection analysis is performed as shown in block 164. A "tram detected" signal 166 is produced as long as the vibration continues and a time period is set before enabling the next detection. If vibration has not been detected in the current time frame, a test is performed as shown in block 168 to determine is the signal amplitude and frequency are in vibration limits. If so, and output pulse is produced as shown in block 170.

The wheel pulse validation signal, the strong pulse validation signal, the vibration pulse validation signal, and the tram detected signal are then subjected to final processing as shown in block 172 to produce an output pulse and a strong pulse. The final processing determines that valid pulses and valid trains (or trams) have been detected and that all other data is valid. Then the correct signal can be sent to an external control box.

The vibration sensor can be mounted in the same housing as the Hall Effect devices and can monitor the levels of vibration at the rail to determine if a train is present. The Hall Effect devices or the vibration sensor can be used independently. When the vibration sensor detects vibration and the magnetic flux changes, a program running in the microprocessor determines if the sensor outputs represent valid information, and then sends a signal to an output device, that can be a digital control box. In one embodiment, the vibration sensor is included on the same printed circuit board (PCB) as the Hall Effect devices and is therefore mounted in the same manner. The vibration sensor can be located beside the magnet and parallel to the Hall Effect devices. While other mounting configurations are possible, this configuration is very compact when both technologies are used at the same time. Since the Hall Effect devices and the vibration sensor can be used independently, the PCB layout can be optimized for each.

The magnetic sensor signals can be processed to extract valid information relating to wheel detection and speed under moderate electromagnetic interference (EMI) and virtually eliminate the chances of false detection under heavy electromagnetic interference. In one embodiment of the invention, if two sets of the magnetic sensors (Hall Effect devices) are either installed together in a larger package or contained in separate housings, a speed measurement can be made based on the distance between the sensors and the time between pulses produced by the sensors. The vibration sensor can be used to validate wheel detection under marginal conditions where signals due to electromagnetic noise may be difficult to distinguish from signals due to a real wheel event, thus extending the range of the sensor to more severe EMI environments. In cases where there is severe electromagnetic interference that causes false triggering, over and above what the algorithm and circuitry can compensate for, the vibration sensor can be used independently to check for vibration levels that give positive confirmation of the presence of a train.

The sensor system of FIG. 1 can be used as a stand-alone data logger that can monitor problem areas for trouble shooting. For example, if there is a location in which the wheel sensor does not seem to be counting correctly, data from that site can show what the sensor is seeing to determine if a given site has some particular previously unseen disturbance. Once these disturbances have been recorded, the programming can be changed accordingly. In the stand-alone mode, the wheel sensor can be installed on a rail and left for an extended period, such as up to 24 hours, during which time it will record the passage of trains or any significant aberrations. The data can be stored inside the stand-alone unit in flash memory. The advantage of this stand-alone model is that the unit can be installed anywhere to record the information without requiring the presence of a user.

This invention provides an accurate indication of the presence of a railway wheel in electrically noisy environments. It can be used in trackside friction management systems or other systems requiring the detection of the presence of a railway wheel. The combination of a vibration sensor and Hall Effect devices ensures that a wheel detection is only validated when the Hall Effect devices indicate the presence of a wheel flange and the vibration level is sufficient to indicate the presence of a train.

By using two of these wheel sensors, speed and direction can be determined based on the distance between the wheel sensors and the timing of the sensor pulses. The actual calculation can be done in a control box that is separate from the sensor housing.

In an alternative embodiment, a speed determination can be made based on the vibration signatures and frequency shifting resulting from the Doppler Effect. In that embodiment, accurate signal processing of a single a dual Hall Effect device output can indicate direction using the propagation properties of the vibrations through the rail.

While the invention has been described in terms of several embodiments, it will be apparent to those skilled in the art that various changes can be made to the described embodiments without departing from the scope of the invention as set forth in the following claims.

What is claimed is:

1. A sensor for sensing the presence of a railway vehicle wheel on an elongated rail, the sensor comprising:

first and second Hall Effect devices;

a magnet for supplying a magnetic field to the first and second Hall Effect devices, wherein the first and second Hall Effect devices are separated in a direction parallel to a direction of travel of the railway vehicle wheel, and are positioned on opposite sides of the magnet;

means for mounting the first and second Hall Effect devices and the magnet adjacent to the rail, whereby a railway vehicle wheel changes the magnetic field in the Hall Effect devices to produce wheel indication signals; and a processor for receiving the wheel indication signals from the first and second Hall Effect devices and for producing an output signal in response to the wheel indication signals, wherein the processor compares the wheel indication signals with predetermined criteria to determine if the wheel indication signals are valid.

2. The sensor of claim 1, wherein the predetermined criteria comprises one or more of: a magnitude threshold, and a range of pulse widths.

3. The sensor of claim 1, wherein the processor determines a speed of the railway vehicle wheel based on a distance between the first and second Hall Effect devices and a time between the wheel indication signals produced by the first and second Hall Effect devices.

4. The sensor of claim 1, wherein the means for mounting the first and second Hall Effect devices and the magnet adjacent to the rail comprises a printed circuit board mounted in a housing.

5. The sensor of claim 1, wherein the polarity of the magnetic field supplied to the first and second Hall Effect devices is the same.

6. A sensor for sensing the presence of a railway vehicle wheel on an elongated rail, the sensor comprising:

first and second Hall Effect devices;

a magnet for supplying a magnetic field to the first and second Hall Effect devices;

means for mounting the first and second Hall Effect devices and the magnet adjacent to the rail, whereby a railway vehicle wheel changes the magnetic field in the Hall Effect devices to produce wheel indication signals;

a processor for receiving the wheel indication signals from the first and second Hall Effect devices and for producing an output signal in response to the wheel indication signals, wherein the processor compares the wheel indication signals with predetermined criteria to determine if the wheel indication signals are valid;

a vibration sensor for sensing vibrations caused by the railway vehicle and for producing a vibration indicating signal; and wherein the processor combines the vibration indicating signal and the wheel indication signals to produce the output signal.

7. The sensor of claim 6, wherein the polarity of the magnetic field supplied to the first and second Hall Effect devices is the same.

8. A method of sensing the presence of a railway vehicle, the method comprising the steps of:

positioning first and second Hall Effect devices adjacent to an elongated rail;

applying a magnetic field to first and second Hall Effect devices, wherein the first and second Hall Effect devices are separated in a direction parallel to a direction of travel of the railway vehicle wheel, and are positioned on opposite sides of a magnet;

producing first and second wheel indication signals in response to changes in the magnetic field in the first and second Hall Effect devices caused by an adjacent railway vehicle wheel;

comparing the wheel indication signals with predetermined criteria to determine if the wheel indication signals are valid; and producing an output signal in response to the first and second wheel indication signals.

9. The method of claim 8, wherein the predetermined criteria comprises one or more of: a magnitude threshold and a range of pulse widths.

10. The method of claim 8, further comprising the step of:

determining a speed of the railway vehicle wheel based on a distance between the first and second Hall Effect devices and a time between the first and second wheel indication signals produced by the first and second Hall Effect devices.

11. The method of claim 8, further comprising the steps of:

sensing vibrations caused by the railway vehicle and producing a vibration indicating signal; and using a Doppler shifted frequency in the vibrations to determine direction of movement of the railway vehicle.

12. The method of claim 8, wherein the polarity of the magnetic field applied to the first and second Hall Effect devices is the same.

13. A method of sensing the presence of a railway vehicle, the method comprising the steps of:

positioning first and second Hall Effect devices adjacent to an elongated rail;

applying a magnetic field to first and second Hall Effect devices;

producing first and second wheel indication signals in response to changes in the magnetic field in the first and second Hall Effect devices caused by an adjacent railway vehicle wheel;

comparing the wheel indication signals with predetermined criteria to determine if the wheel indication signals are valid;

producing an output signal in response to the first and second wheel indication signals;

sensing vibrations caused by the railway vehicle and producing a vibration indicating signal; and combining the vibration indicating signal and the wheel indication signal to produce the output signal.

14. The method of claim 13, wherein the polarity of the magnetic field applied to the first and second Hall Effect devices is the same.

* * * * *